United States Patent [19]

Barish

[11] 4,184,676

[45] Jan. 22, 1980

[54] ELECTRONIC TIC-TACK-TOE GAME

[76] Inventor: Benjamin J. Barish, 103 Ahad Ham'am St., Tel Aviv, Israel

[21] Appl. No.: 860,177

[22] Filed: Dec. 13, 1977

[30] Foreign Application Priority Data

Nov. 7, 1977 [IL] Israel ..... 53316

[51] Int. Cl.[2] ..... A63F 3/00

[52] U.S. Cl. ..... 273/237

[58] Field of Search ..... 273/1 E, 85 G, 237, 273/238; 340/323 R

[56] References Cited

U.S. PATENT DOCUMENTS

| | | | |
|---|---|---|---|
| 2,811,359 | 10/1957 | Haufe | 273/237 |
| 4,006,903 | 2/1977 | Barish | 273/237 |
| 4,019,745 | 4/1977 | Mustelier | 273/237 |

FOREIGN PATENT DOCUMENTS

| | | | |
|---|---|---|---|
| 750828 | 1/1967 | Canada | 273/237 |

OTHER PUBLICATIONS

Electronics, "Tick-Tack-Toe Computer", Aug. 1952, pp. 154, 156, 158, 162.

Electronic Design, "Chess and Chance Games, Win at Electronics Show," Feb. 15, 1977, p. 21.

*Primary Examiner*—Vance Y. Hum

[57] ABSTRACT

A pocket-calculator type electronic game is described for playing Tic-Tack-Toe. The game includes a keyboard having a 3-by-3 matrix of keys each of which may be depressed once to input an "O", and twice to input an "X"; a matrix display for displaying the inputted O's and X's; a mode selector for selectively operating the device according to either a Continuous-Display Mode (wherein the inputted indications are continuously displayed), or a Suppressed-Display Mode (wherein the inputted indications are displayed only when a complete line of one of the indications has been inputted); and a "Tilt" indicator energized whenever a player depresses a key which had previously been depressed in the same game. The latter two features introduce a memory factor in playing the game.

9 Claims, 3 Drawing Figures

ELECTRONIC TIC-TACK-TOE GAME

BACKGROUND OF THE INVENTION

The present invention relates to an electronic device for playing the game Tick-Tack-Toe.

As described in my U.S. Pat. No. 4,006,903, the game Tick-Tack-Toe is a well known one in which two players take turns marking either O's or X's in a 3-by-3 rectangular matrix of nine squares, the object being for each player to complete a line (i.e., a horizontal row, vertical column, or diagonal) of three of his marks before the other player. There are a large number of mechanical and electrical versions of this game. My prior U.S. Pat. No. 4,006,903 describes an electrical version using stylus-actuated switches for inputting the O's and X's.

SUMMARY OF THE INVENTION

The present invention provides a keyboard electronic version for playing the game Tick-Tack-Toe. This version broadly comprises a keyboard including a plurality of manipulatable keyboard elements for inputting an "O" or "X" indication in each position of a 3-by-3 rectangular matrix; optical display means including a matrix display capable of displaying an "O" and an "X" indication in each matrix position; and an electrical circuit including means controlled by the keyboard elements for displaying cumulatively the "O" and "X" indications inputted during a game sequence in the matrix positions inputted.

In the embodiments of the invention described below, the electrical circuit further includes means for detecting when a complete horizontal, vertical, or diagonal line of "O" or "X" indications have been inputted, and suppressing means effective to suppress the matrix display until the inputting of a complete line of "O" or "X" indications has been detected. The provision of this latter feature introduces an important memory factor in playing the game since the players must remember all the previous plays in each game sequence.

In the preferred embodiments described below, the suppressing means includes a mode selector switch selectively positionable either to a first position for suppressing the display of the cumulative indications inputted during a game sequence until the inputting of a complete line of "O" or "X" indications has been detected, or to a second position enabling the matrix display to continuously display the cumulative indications in their maxtrix positions as they are inputted from the keyboard.

According to a further feature included in the described preferred embodiments, the optical display means further includes "O" and "X" indicators respectively energized when the inputting of a complete line of "O" or "X" indications has been detected.

According to another preferred feature in the described embodiments, the electrical circuit further includes means providing a signal (hereinafter called "Tilt") whenever any one of the manipulatable elements of the keyboard has been manipulated to input an indication twice during the same game sequence. This feature, used when the cumulative inputted indications are suppressed, further strengthens the memory factor in playing the game.

One described embodiment further includes a "Draw" indicator to indicate when the game has ended in a Draw.

According to a still further feature in the described embodiments, the manipulatable elements are depressable keys each of which is depressable once to input one indication (e.g., an "O"), and twice to input the other indication (e.g., an "X").

The keyboard, optical display, and electronic circuit, are preferably all contained in a single hand-held unit approximately the size of the small pocket calculators in wide-spread use today, thereby providing a small, lightweight, self-contained, durable game which can be produced in volume and at low cost using the same techniques as are used today for producing the small pocket calculators.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
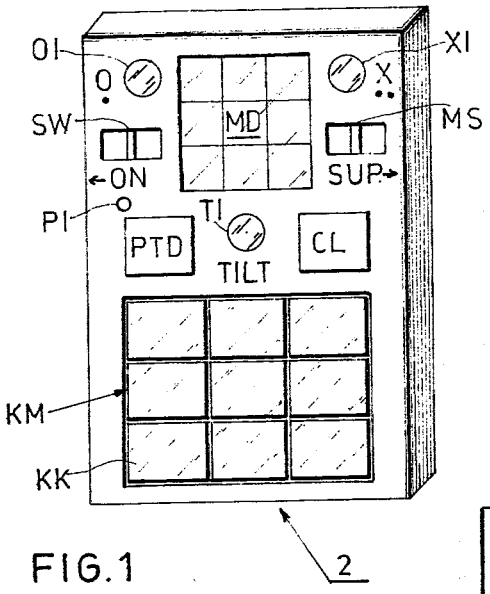
FIG. 1 illustrates the outer appearance of one form of device constructed in accordance with the invention for playing the game Tick-Tack-Toe.

As shown in FIG. 1, the illustrated device, generally designated 2, is constructed as a single, compact, hand-held unit having a keyboard matrix KM in the form of a rectangular 3-by-3 matrix of nine depressable keys KK. The keyboard further includes a manual "On-Off" switch SW, a Mode Selector switch MS, a Clear key CL, and a Press-to-Display key PTD. The illustrated device further includes a display comprising a 3-by-3 matrix display MD corresponding to the keyboard matrix KM, an O-indicator OI, an X-indicator XI, a "Tilt" indicator TI, and a "Power-ON" indicator PI.

The keyboard keys KK in the 3-by-3 matrix KM are each depressable once to input an "O" indication, and twice to input an "X" indication, which indications may be displayed on the display MD in the matrix positions inputted. Thus, the display MD would include a 3-by-3 matrix of indicator elements such as are commonly used in hand-held calculators, except that each matrix position displays only two indications, namely, an "O" indication by indicator elements OE (FIG. 2), and an "X" indication by indicator elements XE.

The device further includes an electrical circuit which detects when a complete line (horizontal row, vertical column, or diagonal) of "O" or "X" indications have been inputted by the keyboard switches KK, and as soon as this occurs, the circuit energizes the appropriate O-indicator OI or X-indicator XI.

The Mode Selector Switch MS is used for selecting one of two modes of operation, namely: a Continuous-Display Mode, wherein the matrix display MD continuously and cumulatively displays the inputted indications, as each is inputted; or a Suppressed-Display Mode, wherein the matrix display is suppressed until the inputting of a complete line of O's or X's has been detected. As mentioned earlier, playing the game in the Suppressed-Display Mode introduces an important memory factor which makes the game more challenging to play since the players must remember all the previous plays.

The "Tilt" indicator TI is automatically energized whenever a keyboard key KK is depressed to indicate one indication wherein, in the same game sequence, the same key had been previously depressed to indicate the other indication. Such a double-operation of the same key could be considered as ending the game in a loss against the player committing it. This feature therefore emphasizes the memory factor when the game is played in the Suppressed-Display Mode, since a "Tilt" dramatically signals an instant loss.

The press-to-display key PTD is provided to permit a momentary display of the previously inputted indications when the game is being played in the Suppressed-Display Mode.

Clear key CL is depressed at the end of each game sequence in order to clear the device; manual switch SW switches on the device preparatory to playing the game; and indicator PI indicates when power is switched-on.

Figure 2:
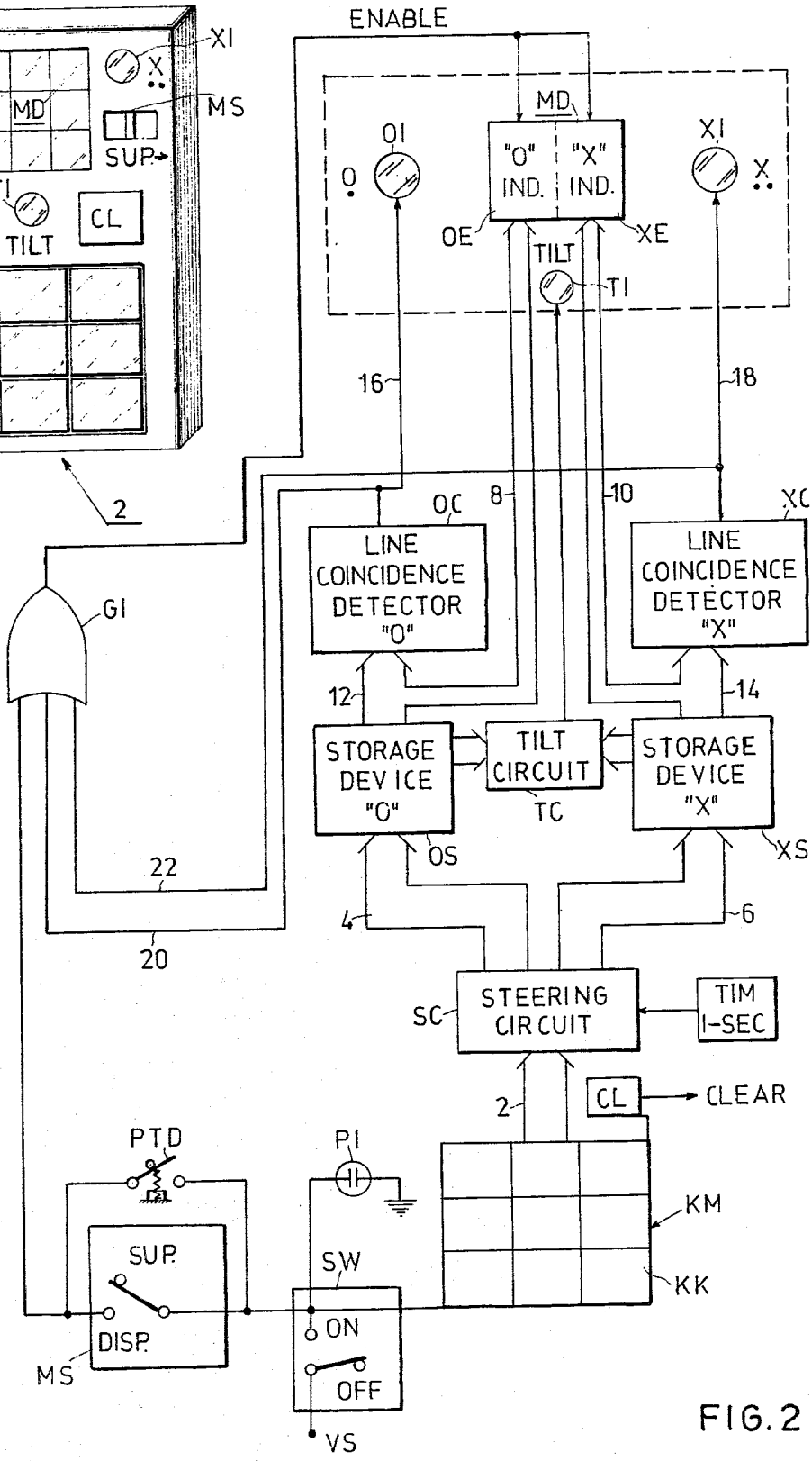
FIG. 2 is a logical circuit diagram illustrating one circuit which may be used in the device of FIG. 1.

FIG. 2 illustrates, for purposes of example, one circuit, based on conventional logic elements, which could be used to implement the above-described operation of the game illustrated in FIG. 1.

The 3-by-3 matrix keys KK may be conventional depressable keys, such as commonly included in hand-held calculators, effective upon each depression to close and open an electrical switch and thereby to produce an electrical pulse. As mentioned above, an "O" indication is inputted by one depression of the key, and an "X" indication is inputted by two depressions (performed quickly) of the key. Preferably, this is made readily discernable to the players by marking the face of the device with a single-dot below the "O" for the O-indicator OI and a double-dot below the "X" for the X-indicator XI, as shown in FIG. 1. Each key KK could be similarly marked, e.g., with an "O" enclosing an "X", with two dots below the "X".

The oututs of the matrix keys KK are fed via a nine-line bus 2 to a steering circuit SC which directs the single-pulse ("O") indications via bus 4 to an O-storage device OS, and the double-pulse ("X") indications via bus 6 to an X-storage device XS. The outputs of the latter storage devices are connected, via buses 8 and 10, to the "O" indicator elements OE and the "X" indicator elements XE, respectively, of the matrix display MD.

The steering circuit SC may comprise any known circuit for steering the single-pulse inputs to storage device OS and the double-pulse inputs to storage device XS. For example, it could include a base-3 counter for each of the nine lines from the keyboard matrix switches KK, each counter outputting a pulse to the corresponding line in the O-storage device OS when it receives a single-pulse input, or to the corresponding line in the X-storage device XS when it receives a double-pulse input. Each such line of the steering circuit is automatically initialized by a timer TIM after the elapse of a predetermined time interval from its actuation, which time interval (e.g., 1-second) should be longer than the usual time for depressing the same key KK twice by the same player to input an "X" indication, but shorter than the usual time for depressing the keys by different players when the turn passes from one player to the next.

The two storage devices OS and XS may comprise a flip-flop for each of the nine lines, each flip-flop producing a logical "1" output to its respective indicator element (OE or XE) of the matrix display MD when a pulse is received from the steering circuit SC, and a logical "0" output when no pulse is received.

Each of the storage devices OS and XS is also connected, via buses 12 and 14 respectively, to a coincidence circuit OC and XC which circuits determine whether a complete line (horizontal, vertical or diagonal) of three keys in the matrix keyboard keys KK have been operated for any one indication. When either of the coincidence circuits OC or XC has detected this coincidence for its respective indication ("O" or "X"), it outputs a signal, via line 16, 18, to energize its respective indicator OI, XI, to indicate the coincidence. Thus, as soon as a coincidence of three O's has occurred, indicator OI will be energized; and as soon s a coincidence of three X's has occurred, indicator XI will be energized.

For purposes of example, the line-coincidence circuits OC and XC may be of the type described in my prior U.S. Pat. No. 4,006,903, each including eight 3-input AND-gates leading to an OR-gate whose output is the line (16 or 18) leading to the respective indicator (OI or XI). Thus, each of the eight AND-gates detects a coincidence with respect to any line of three in the matrix, there being eight such lines (three horizontal, three vertical and two diagonal); and the OR-gate outputs the energizing signal to the respective indicator (OI, XI) whenever any one of the eight AND-gates has outputted a signal indicating a coincidence.

As mentioned above, the illustrated device can be operated either in the Continuous-Display mode or in the Suppressed-Display mode by presetting the mode selector switch MS. When switch MS is in the DISP (Continuous-Display) position (FIG. 2), an "enable" signal is continuously fed through an OR-gate G1 to the matrix display MD, thereby enabling the latter to display, continuously and cumulatively, the O-indicator and X-indicator elements as the respective keyboard keys KK are depressed. On the other hand, if mode selector switch MS is in the SUP (Suppressed-Display) position, this "enable" signal is not outputted by the OR-gate G1 until one of the two line-coincidence circuits (OC, XC) detects a line coincidence; when this occurs, a signal is fed from the respective coincidence circuit, via line 20 or 22, to gate G1 to output the "enable" signal to the matrix display MD, and thereby to display all the previous "O" and "X" inputs, including those which produced the winning coincidence.

Thus, operating the game under the Suppressed-Display mode introduces a memory factor which requires the players to be alert and to remember all the previous plays. Only when one player succeeds in producing a coincidence, is the matrix display MD energized to display all the previous plays.

This memory factor in playing the game is emphasized by the provision of the "Tilt" circuit TC which energizes the Tilt indicator T1 (FIG. 1) whenever a player depresses a key which had been previously depressed by the other player in the same game sequence. If one player depresses a key which he himself had previously depressed in the same game sequence, he will merely have wasted his turn, but if depresses a key which had been previously depressed by another, indicator TI will be immediately energized signalling this fact and ending the game in favor of the other player. A suitable circuit could be one including 9 AND-gates, one for each matrix position, each gate including two inputs, one from each of the storage devices OS, XS, the outputs of the AND-gates being fed via an OR-gate to indicator TI, similar to the arrangement described in the above-cited U.S. Patent.

If it is desired, when playing the game under the Suppressed-Display Mode, to momentarily energize the matrix display MD (for example to settle an argument as to a previous play), this can be done by depressing the press-to-display key PTD which momentarily bypasses the mode-selector switch MS to produce the "enable" pulse via gate G1 to the matrix display MD.

The manual switch SW connects the circuit to a voltage source VS, preferably a self-contained battery. When the switch is turned on, power indicator PI is energized. The clear key CL, when depressed, outputs a Clear signal which clears the above-described circuits and displays, and prepares the device for a new game sequence.

Figure 3:
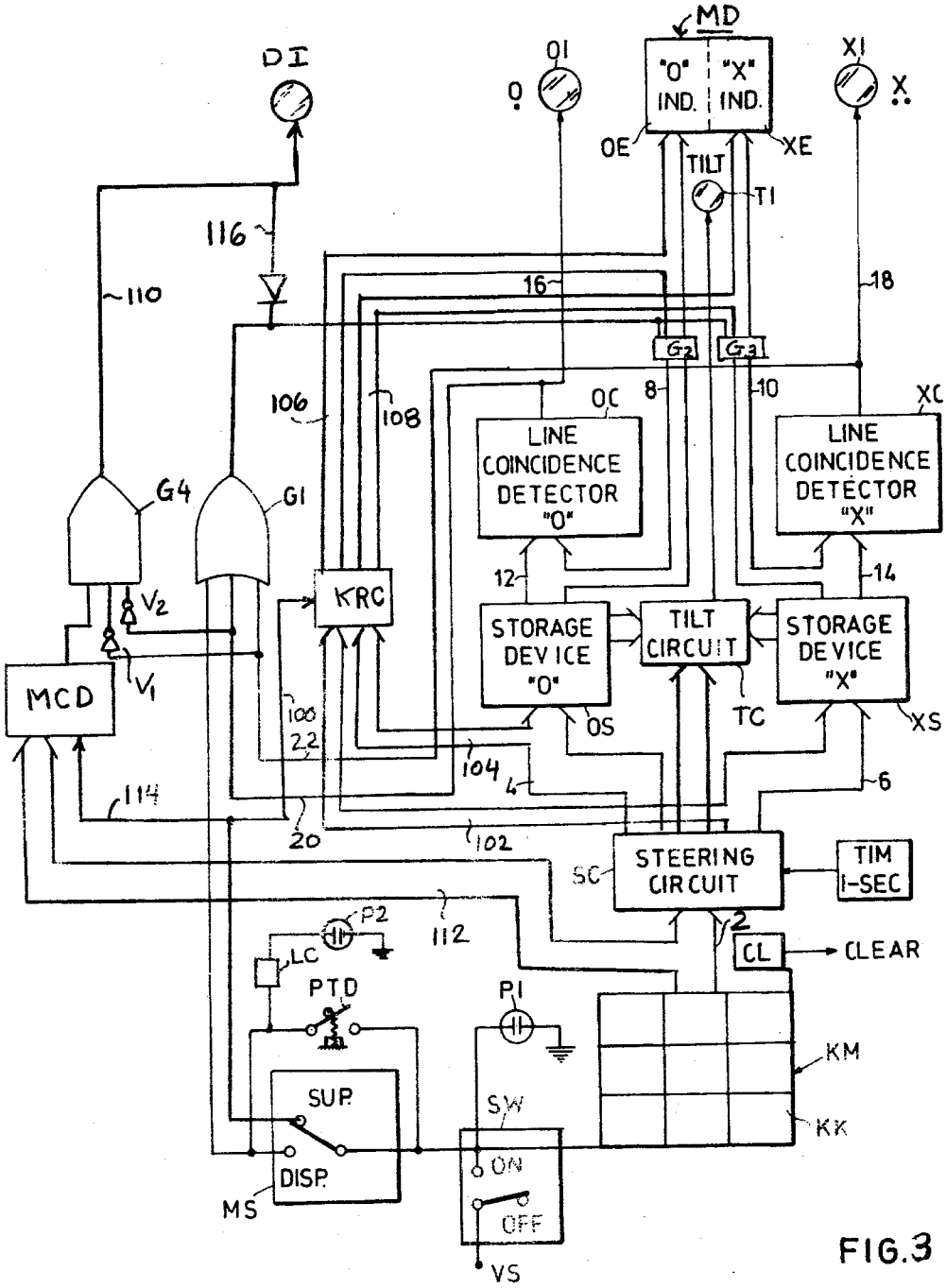
FIG. 3 is a diagram similar to FIG. 2 but illustrating a second circuit which may be used.

FIG. 3 illustrates a system similar to that of FIG. 2 but including a number of further features particularly applicable in the Suppressed-Display mode of operation. The elements in FIG. 3 which are generally common to those in FIG. 2 are identified by the same reference characters, and therefore their functions will be as described above. Following is a description of the new features included in the circuit of FIG. 3.

Thus, the system illustrated in FIG. 3 includes a keyboard read-out control unit KRC which is enabled (via line 100) during the Suppressed-Display mode, to read-out (via busses 102, 104, 106, and 108) the indication ("O" or "X") inputted by the operated keyboard key KK, the indication being read-out to the corresponding "O" or "X" indicator (OE, XE) in the matrix display MD, such that the latter displays only the individual indication last inputted and in the matrix position inputted.

Further, in the system in FIG. 3 the enabling of the display in unit MD by the signal outputted from gate G1 is effected by applying the latter signal to gates (G2, G3) in the input busses (8, 10) to the matrix display MD, rather than to the matrix display MD itself as described in FIG. 2.

Another modification in the system of FIG. 3 is that the tilt circuit TC senses a double entry by the same key, whether the entry is by the same player or by the other player. For this purpose the tilt circuit is connected to the keyboard directly, or via the steering circuit SC as shown. The tilt circuit here could be in the form of a base-3 counter for each of the nine lines, which counter is stepped one increment for each indication inputted by its respective key, the third step (reached upon inputting two indications) of all the counters being connected to the tilt indicator TI.

The system of FIG. 3 further includes a light indicator P2, and a latching circuit LC across the press-to display switch PTD, such that upon the pressing the latter switch, indicator P2 is latched energized until the latch LC is cleared by the Clear Key CL at the end of a game sequence.

Finally, the circuit of FIG. 3 includes a "Draw" indicator DI controlled (via line 110) by a matrix coincidence detector circuit MCD connected to the keyboard matrix KM (via bus 112), such that when all the keys have been depressed during a single game sequence (i.e., before the clear key CL is depressed), with no detection of the inputting of a winning line of indications (via inverters V1, V2 and AND-gate G4), the "Draw" indicator DI will be energized to signal a "Draw" situation. The matrix coincidence detector circuit MCD is preferably enabled (via line 114) only during the Suppressed Mode. Upon sensing a "Draw", the matrix display MD is actuated (via line 116 and gates G2, G3) to display all the previously inputted indications.

The foregoing features illustrated in the system of FIG. 3 are particularly applicable during a Suppressed-Display mode of operation of the device when the cumulative indications inputted are suppressed from being displayed in the matrix display MD until the detection of a winning line of the same indication as described above. Thus, each time a player inputs his respective indication ("O" or "X"), this indication will be displayed (via unit KRC) in the Matrix Display MD, so that the other player need not actually view the act of inputting of the indication by the other player as he will see it on the display. Each inputted indication is displayed only until the next indication is inputted. In case one player (out of the view of the other) presses the switch PTD to see all the previously inputted indications, this fact will be made apparent by the energization of light P2 which light will remain energized (by the latching circuit LC) until cleared at the end of the game sequence. Further, if all the keyboard keys KK are eventually operated without either player completing a winning line of indications, the "Draw" Indicator DI will be energized (via line 110), thereby signalling that the game has ended in a "Draw", in addition, all the inputted indications will be displayed (controlled by line 116 and gates G2, G3) in the matrix display MD.

At the end of each game sequence, whether ending in a "Win", "Draw", or "Tilt", the clear key CL is depressed to clear or normalize all the components of the system to enable a new game sequence to be played.

The devices illustrated can be easily constructed, by using existing IC (integrated circuit) or LSI (large-scale integrated circuit) techniques, in the form of small, handheld units no bigger than the size of the common pocket calculator, and considerably less complicated function-wise. While a conventional logic circuit implementation has been described above for purposes of example, and for more readily understanding the logical functions involved, it will be appreciated that the device could also be implemented by using known microprocessor design and programming techniques such as are now commonly available for the small pocket calculators.

Further, while the use of depressable keys KK for the manipulatable keyboard elements is particularly advantageous, other keyboard elements could be used, for example pivotable levers or shiftable slides, movable in one direction for inputting an "O" indication and in the opposite direction for inputting and "X" indication. Also, some features could be omitted, and others added. The device, particularly when implemented with a microprocessor, could also include a program which enables the game to be played by one person in solitaire fashion, the program itself providing the opposition according to one or more (prefixed or random) possibilities so as to make the opposition substantially unpredictable, also as known in solitaire chess games, for example.

Further, the Rules of the game could be varied to add to the possible options available to the player. For example, the Rules of the FIG. 3 embodiment could permit each player to input not only his indication, but also that of the other, in an attempt to confuse the other into committing a "tilt"; or, the Rules could provide that the completion of a line of a player's indication constitutes a "loss" rather than a "win", whereby the strategy of each player is "to force" the other to complete a line of his indication. It will thus be seen that the described game introduces a new dimension of strategy available, as well as of memory and alertness required, not present in the conventional Tick-Tack-Toe game.

Another variation of the device, particularly when microprocessor-implemented, is in combination with a pocket calculator. Such a combination can be constructed at little additional cost since the calculator read-out elements could include one horizontal line (e.g. the top line) of the matrix display indicator elements aligned on one side by two of the four remaining indicators (OI, XI, TI, DI) and on the opposite side by the other two indicators, to provide a 7-digit read-out. The matrix keys KK could be used as the calculator digit keys, requiring only the addition of the "O" key, "decimal key", the function keys, and any other desired special keys.

Many other variations and applications of the invention will be apparent.

What is claimed is:

1. An electrical device for playing the game Tick-Tack-Toe, comprising: a keyboard including a plurality of manipulatable keyboard elements for inputting an "O" or "X" indication in each position of a 3-by-3 rectangular matrix; optical display means including a matrix display capable of displaying an "O" and an "X" indication in each matrix position; and an electrical circuit including means controlled by said keyboard elements for displaying cumulatively the "O" and "X" indications inputted during a game sequence in the matrix positions inputted, means for detecting when a complete horizontal, vertical, or diagonal line of "O" or "X" indications have been inputted, and suppressing means effective to suppress the display in said matrix display of the cumulative indications inputted during a game sequence until the inputting of a complete line of "O" or "X" indications has been detected.

2. A device according to claim 1, wherein said electrical circuit further includes means effective to display in the matrix display only the individual indication last-inputted during a game sequence.

3. A device according to claim 1, wherein said suppressing means includes a mode selector switch selectively positionable either to a first position for suppressing the display in said matrix display of the cumulative indications inputted during a game sequence until the inputting of a complete line of "O" or "X" indications has been detected, or to a second position enabling said matrix display to continuously display the cumulative indications in their matrix positions as they are inputted from the keyboard.

4. A device according to claim 1, wherein said keyboard further includes a press-to-display key, and said electrical circuit further includes means effective, when said latter key is depressed, to over-ride said suppressing means and to enable said matrix display to display the cumulative indications inputted during the game sequence.

5. The device according to claim 1, wherein said optical display means further includes "O" and "X" indicators respectively energized when the inputting of a complete line of "O" or "X" indications has been detected.

6. The device according to claim 1, wherein said electrical circuit further includes means providing a signal whenever any one of the manipulatable elements of the keyboard has been previously manipulated during the same game sequence.

7. A device according to claim 1, wherein said electrical circuit further includes means signalling a "Draw" condition whenever all the manipulatable elements of the keyboard have been manipulated to input either of said indications during the same game sequence with a complete line of one of said indications not having been detected.

8. The device according to claim 1, wherein said manipulatable elements are depressable keys, said electrical circuit further including means whereby the depression of a key once inputs one indication and twice inputs the other indication.

9. The device according to claim 1, wherein said keyboard, optical display means, and electrical circuit are all contained on a single hand-held portable unit.

* * * * *